US006848132B1

(12) United States Patent
Dale

(10) Patent No.: US 6,848,132 B1
(45) Date of Patent: Feb. 1, 2005

(54) BEDSIDE ORGANIZER

(76) Inventor: Josie E. Dale, P.O. Box 78801, Los Angeles, CA (US) 90016

( * ) Notice: Subject to any disclaimer, the term of this patent is extended or adjusted under 35 U.S.C. 154(b) by 0 days.

(21) Appl. No.: 10/679,149

(22) Filed: Oct. 3, 2003

Related U.S. Application Data

(63) Continuation-in-part of application No. 10/179,837, filed on Jun. 24, 2002, now abandoned.

(51) Int. Cl.[7] ..... A47C 21/00; B65D 30/22; B65D 33/14

(52) U.S. Cl. ..... 5/503.1; 383/7; 383/38

(58) Field of Search ..... 5/503.1, 658; 383/6, 383/7, 38, 39; 224/156, 584, 923

(56) References Cited

U.S. PATENT DOCUMENTS 4,129,909 A * 12/1978 Riehl ..... 5/503.1
5,581,829 A * 12/1996 Lee ..... 5/503.1
6,148,459 A * 11/2000 Verhulst ..... 5/503.1
6,233,765 B1 * 5/2001 Verhulst ..... 5/503.1
6,374,440 B1 * 4/2002 Thim, Jr. ..... 5/633
2002/0018601 A1 * 2/2002 Nelson ..... 383/7
2004/0016055 A1 * 1/2004 Lamy ..... 5/485

* cited by examiner

*Primary Examiner*—Robert G. Santos
(74) *Attorney, Agent, or Firm*—Goldstein Law Offices, P.C.

(57) ABSTRACT

A bedside organizer for holding various items typically used while in bed. When in place over the bed, the organizer extends from one side of the bed, over the top surface, to the opposite side of the bed. The bedside organizer has two side portions and a middle portion extending therebetween. Each side portion has a top edge, a bottom edge, and a number of pouches extending between the top edge and the bottom edge. Each pouch has a top opening through which items may be inserted. An overlay extends from the top edge of the side portion over the top openings of the pouches. In order to retrieve the items in the pouches, the overlay is raised upward, thereby exposing the top openings of the pouches.

2 Claims, 3 Drawing Sheets

BEDSIDE ORGANIZER

CROSS REFERENCES AND RELATED SUBJECT MATTER

This application is a continuation-in-part of utility patent application Ser. No. 10/179,837, filed in the United States Patent & Trademark Office on Jun. 24, 2002 now abandoned.

BACKGROUND OF THE INVENTION

The invention relates to a bedside organizer. In particular, the invention is an organizer having a plurality of pouches, said organizer constructed to extend across a bed, with storage portions hanging flat against either side of the bed.

"Side tables" or nightstands are typically placed on the side of a bed. They provide storage for various items that may be used while in bed. Such items may include eyeglasses, television remote controls, books, cellular telephones, water bottles, and flashlights. While such items can often be conveniently placed on a nightstand and thus be readily available to the user, these objects can easily cause unsightly clutter.

Thus, there exists a need for an organizer that has a plurality of pouches sized to hold objects used while in bed, such as those named above. Such an organizer should be constructed to hang along the sides of the bed, thus eliminating any clutter on the side table.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved bedside organizer. As such, the general purpose of the present invention, which will be described subsequently in greater detail, is to provide a new and improved bedside organizer which has all the advantages of the prior art and none of the disadvantages.

To attain this, the present invention essentially comprises a bedside organizer for holding various items typically used while in bed. The bedside organizer has two side portions and a middle portion extending therebetween. When in place over the bed, the organizer extends from one side of the bed, over the top surface, to the opposite side of the bed. Each side portion has a top edge, a bottom edge, and a number of pouches extending between the top edge and the bottom edge. Each pouch has a top opening through which items may be inserted. An overlay extends across the top edge of each side portion, and conceals the top openings of the pouches. In order to retrieve the items in the pouches, the overlay is raised upward, thereby exposing the top openings of the pouches.

It is an object of the invention to produce a bedside organizer that is capable of holding various items that are typically used while in bed. Accordingly, the organizer has a plurality of flexible pouches that can hold different objects.

It is a further object of the invention to produce a bedside organizer that is accessible while in bed. Accordingly, the organizer is constructed to extend across the width of the bed such that the pouch portions of said organizer lie flat against the sides of the bed.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Reference Numerals

Figure 1:
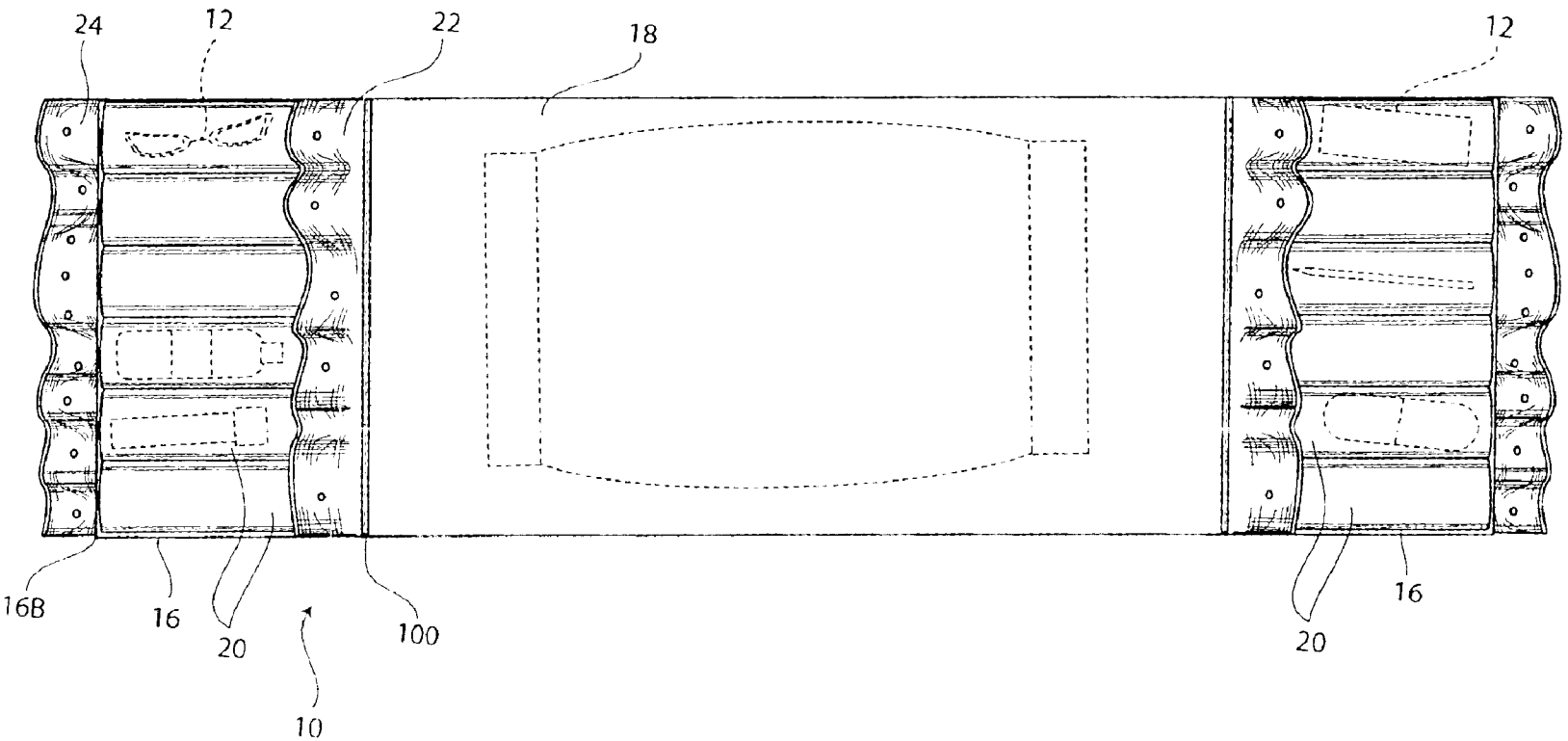
FIG. 1 is a top plan view of the bedside organizer.
Figure 2:
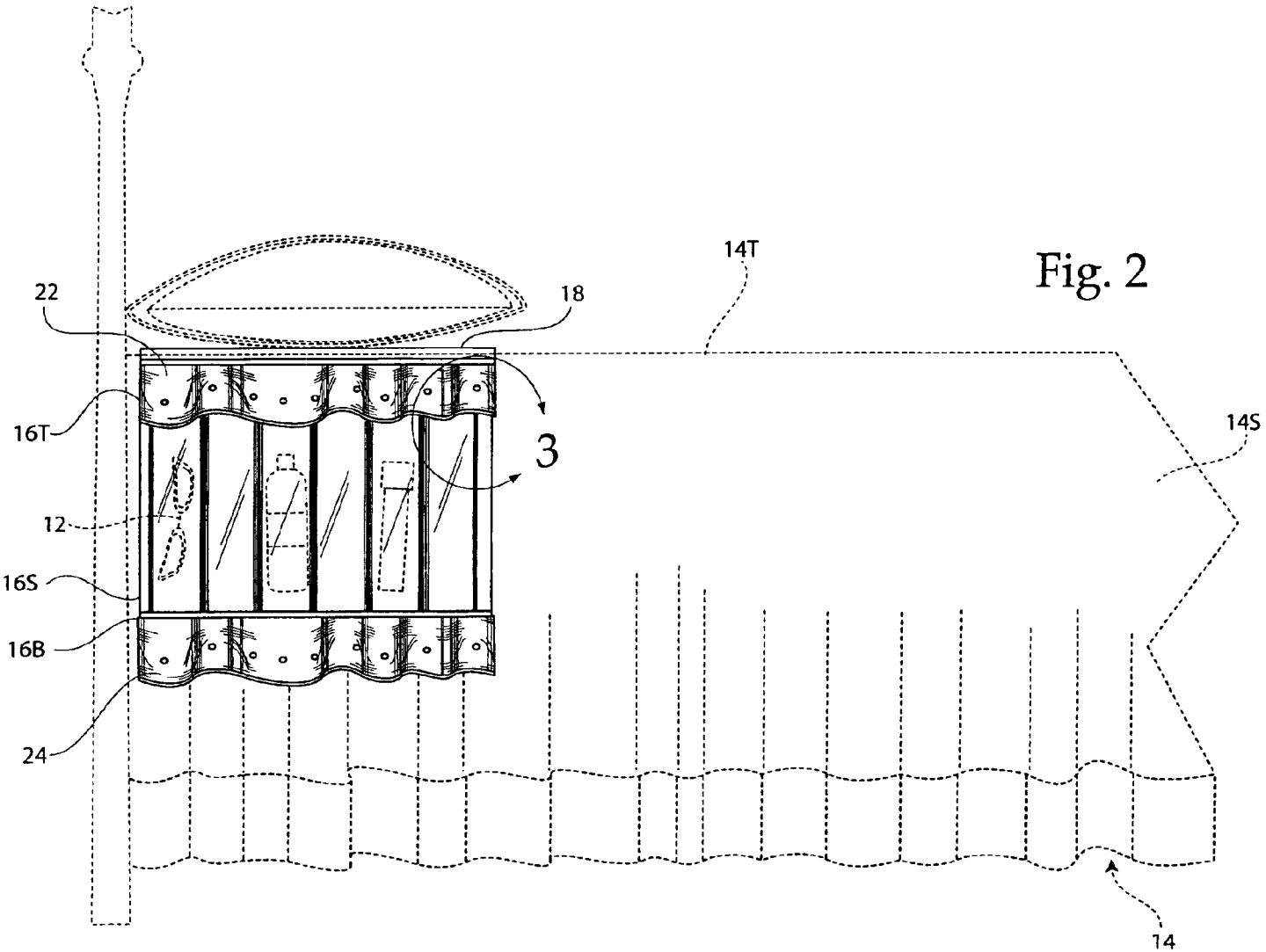
FIG. 2 is a side elevational view of a bed, with the bedside organizer positioned thereon, the bed shown in broken lines.

10 bedside organizer
10F front surface of organizer
10U underside of organizer
12 item in organizer
14 bed
14T top surface of bed
14S side of bed
16 side portion of organizer
16T top edge of side portion
16B bottom edge of side portion
18 middle portion of organizer
20 pouch
20T pouch opening
22 overlay
24 lace extension

DETAILED DESCRIPTION OF THE PREFERRED EMBODIMENTS

FIG. 1 illustrates a bedside organizer 10 for holding a plurality of items 12 typically used while in bed 14. The bed 14 has a flat top surface 14T and two sides 14S.

The bedside organizer 10 essentially comprises an elongated piece of material, the piece having a front surface 10F, an underside 10U, two side portions 16, and a middle portion 18 extending therebetween. The middle portion 18 is flat and sized to fit across the width of the bed 14. The organizer 10 is available in a variety of lengths to accommodate different sized beds 14. When in place over the bed 14, the organizer 10 extends from one side 14S of the bed 14, over the top surface 14T, to the opposite side 14S. The middle portion 18 is sized to extend from side 14S to side 14S.

Figure 3:
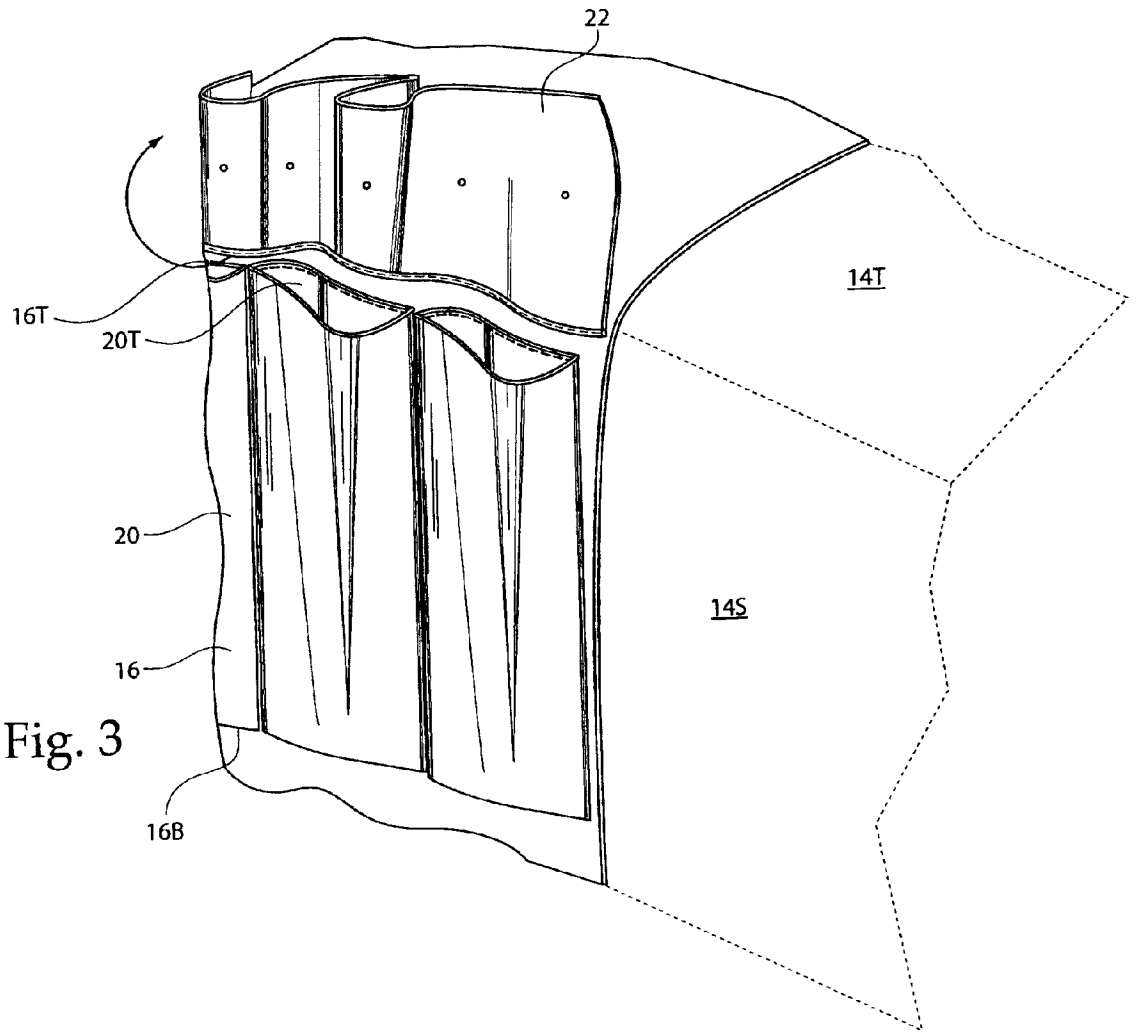
FIG. 3 is a side perspective view of the bedside organizer side portion with the overlay in the raised position, revealing the top openings, and wherein the bed is shown in broken lines.

Each side portion 16 has a top edge 16T and a bottom edge 16B. A plurality of vertical pouches 20 are stitched on the front surface 10F, said pouches 20 extending between the top edge 16T and the bottom edge 16B. Each pouch 20 has a pouch opening 20T just below the top edge 16T through which items 12 may be inserted. An overlay 22 extends from the top edge 16T of the side portion 16 and selectively extends over the top openings 20T of the pouches 20 and conceals all of the pouch openings 20T. In order to retrieve the items 12 in the pouches 20, the overlay 22 is raised upward, thereby exposing the pouch openings 20T, as illustrated in FIG. 3. The pouches 20 may be constructed from an elastic material to allow flexibility to expand to accommodate larger items, yet remain relatively inconspicuous when empty.

In use, the appropriate sized bedside organizer 10 is chosen according to the size of the bed 14 on which said organizer 10 is to be utilized. In particular, if the middle portion 18 matches the width of the bed 14, the top edges 16T of the side portions 16S will be located at the joinder of the bed sides 14S and top surface 14T of the bed 14. The organizer 10 is extended flat across the width of the bed 14. The underside 10U of the middle portion 18 of the organizer 10 is rested on top of the top surface 14T of the bed 14. When the middle portion 18 is properly positioned and sized, the side portions 16 extend downward along the bed sides 14S. In order to insert items 12 into the pouches 20 or to retrieve items 12 therefrom, the overlay 22 is lifted upward, thus making the top openings 20T of the pouches 20 accessible.

The design of the side portions 16 of the bedside organizer 10 may be chosen to match the bed linens used on the bed 14. As illustrated in FIGS. 1 and 3, a lace extension 24 may be attached to the bottom edge 16B of each side portion 16 to simulate a dust ruffle of conventional bedding.

In conclusion, herein is presented a bedside organizer. The invention is illustrated by example in the drawing figures, and throughout the written description. It should be understood that numerous variations are possible, while adhering to the inventive concept. Such variations are contemplated as being a part of the present invention.

What is claimed is:

1. A bedside organizer for positioning on a bed, the bed having a top surface width and two sides, comprising:

an elongated piece of fabric, the piece having an underside, a top surface, two side portions, and a middle portion extending therebetween, the middle portion having a width equivalent to the bed top surface width, each side portion having a distinctive top edge near its upper end and a distinctive bottom edge near its lower end;

a plurality of vertical pouches extending between the top and bottom edges of the side portions, each of said pouches having a pouch opening adjacent to the top edge of the side portion; and wherein each side portion further comprises a pair of overlays, each overlay attached to the top edge of each side portion and selectively extending over the openings of the pouches to conceal said pouches and selectively allow access to said pouches through the pouch openings of said pouches.

2. The bedside organizer as recited in claim 1, wherein the pouches are constructed from an elastic material.

* * * * *